US008484779B1

(12) United States Patent
Bradwell

(10) Patent No.: US 8,484,779 B1
(45) Date of Patent: Jul. 16, 2013

(54) MORTICIAN'S HAIRSTYLING TROLLEY

(76) Inventor: Sonja L. Bradwell, Tallahassee, FL (US)

( * ) Notice: Subject to any disclaimer, the term of this patent is extended or adjusted under 35 U.S.C. 154(b) by 335 days.

(21) Appl. No.: 13/035,370

(22) Filed: Feb. 25, 2011

Related U.S. Application Data

(60) Provisional application No. 61/307,891, filed on Feb. 25, 2010.

(51) Int. Cl.
*A47B 13/00* (2006.01)
*A47B 7/02* (2006.01)

(52) U.S. Cl.
USPC ..... 5/610; 5/11; 5/611; 5/606; 5/600; 5/671; 108/24

(58) Field of Classification Search
USPC ..... 5/11, 600, 610, 611, 671; 108/24
See application file for complete search history.

(56) References Cited

U.S. PATENT DOCUMENTS

| | | | | |
|---|---|---|---|---|
| 214,271 | A * | 4/1879 | Zundorff | 312/228 |
| 503,969 | A | 8/1893 | Huddleston | |
| 621,252 | A * | 3/1899 | Johnson | 5/606 |
| 1,776,167 | A | 9/1930 | Stenshoel | |
| 1,796,493 | A | 3/1931 | Thompson | |
| 2,090,865 | A | 8/1937 | Hanson | |
| 2,693,987 | A | 11/1954 | Wall et al. | |
| 2,924,832 | A * | 2/1960 | Knowles | 5/606 |
| 3,034,843 | A * | 5/1962 | Moon | 312/236 |
| 3,751,028 | A | 8/1973 | Scheininger et al. | |
| 3,799,534 | A * | 3/1974 | Coles | 5/621 |
| 4,418,900 | A | 12/1983 | Ricke | |
| 4,435,862 | A * | 3/1984 | King et al. | 5/611 |
| 4,617,706 | A | 10/1986 | Waletzko | |
| 4,690,417 | A | 9/1987 | Betts et al. | |
| 4,779,878 | A | 10/1988 | Betts et al. | |
| 4,819,925 | A * | 4/1989 | Linnemann et al. | 5/606 |
| 4,843,690 | A | 7/1989 | Iacobucci et al. | |
| 5,479,852 | A | 1/1996 | Lloyd | |
| 5,507,078 | A * | 4/1996 | Gunya et al. | 27/21.1 |
| 5,568,817 | A * | 10/1996 | Harty | 128/849 |
| 5,598,590 | A * | 2/1997 | Crawford et al. | 4/540 |
| 5,839,135 | A * | 11/1998 | Kitamura | 5/606 |
| 5,909,970 | A * | 6/1999 | Velazquez | 4/585 |
| 6,192,809 | B1 | 2/2001 | Riach et al. | |
| 6,279,510 | B1 * | 8/2001 | Batterton | 119/753 |
| 6,543,068 | B1 * | 4/2003 | Penninger | 4/585 |
| 6,802,088 | B1 * | 10/2004 | Gruner | 4/555 |

(Continued)

FOREIGN PATENT DOCUMENTS

WO 0241725 A1 5/2002

*Primary Examiner* — Robert G Santos
*Assistant Examiner* — Ifeolu Adeboyejo
(74) *Attorney, Agent, or Firm* — Montgomery Patent & Design; Robert C. Montgomery

(57) ABSTRACT

A table suited for a stylist when styling hair of a deceased body is configured to hold the deceased body to allow hair to be styled. The table has a set of scissor-like supports with a foot-actuated control, thereby providing a means to adjustably elevate and lower the table. The table may also be angled via a pair of foot-actuated controls. A footrest at the table's base supports the deceased person along with a plurality of body securing straps. The table also comprises a separate platform for allowing the stylist to store products within and a neck support to further support the deceased body configuration resulting in optimum hairstyling.

18 Claims, 11 Drawing Sheets

U.S. PATENT DOCUMENTS

| | | | | |
|---|---|---|---|---|
| 6,966,900 | B1 * | 11/2005 | Chyba et al. | 604/290 |
| 7,140,054 | B2 * | 11/2006 | Charles | 5/606 |
| 7,140,055 | B2 * | 11/2006 | Bishop et al. | 5/611 |
| 7,293,834 | B2 | 11/2007 | Riach et al. | |
| 7,322,079 | B2 * | 1/2008 | Davis et al. | 27/19 |
| 7,766,174 | B2 * | 8/2010 | Abraitis | 211/36 |
| 2006/0225203 | A1 * | 10/2006 | Hosoya et al. | 5/86.1 |
| 2008/0127417 | A1 * | 6/2008 | Harty | 5/606 |
| 2008/0276372 | A1 * | 11/2008 | Lambarth | 5/611 |
| 2010/0064441 | A1 * | 3/2010 | Barthelt | 5/616 |
| 2011/0000058 | A1 * | 1/2011 | Spiers | 27/1 |
| 2011/0030136 | A1 * | 2/2011 | Kim | 4/547 |

* cited by examiner

MORTICIAN'S HAIRSTYLING TROLLEY

RELATED APPLICATIONS

The present invention was first described in and claims the benefit of U.S. Provisional Application No. 61/307,891 filed Feb. 25, 2010, the entire disclosures of which are incorporated herein by reference.

FIELD OF THE INVENTION

The present invention relates generally to mortician tables, and in particular, to a powered, adjustable hairstyling trolley particularly adapted for mortuary applications.

BACKGROUND OF THE INVENTION

There are many preparations that must take place on the body of a deceased person in order to prepare it for viewing and subsequent internment. Along with the embalming process, selection of clothes, selection of jewelry, makeup, and the like, the person's hair must be styled as well. The whole act of washing the hair, drying it, cutting it, and styling it is exceedingly difficult. Great care must be taken in order to produce a look that is both similar to the hairstyle the client had while living as well as provide a natural appearance. This hairstyling process is somewhat difficult due to the horizontal nature of the client and the fact that the mortician must manually manipulate the position of the client during the process.

Various attempts have been made to provide support tables or other structures for use by a mortician. Examples of these attempts can be seen by reference to several U.S. patents including U.S. Pat. No. 2,090,865; U.S. Pat. No. 3,799,534; U.S. Pat. No. 4,418,900; U.S. Pat. No. 4,617,706; and U.S. Pat. No. 4,843,690. However, none of these designs are similar to the present invention.

While these apparatuses fulfill their respective, particular objectives, each of these references suffer from one (1) or more of the aforementioned disadvantages. Many such apparatuses do not provide a full range of positional adjustability as necessary for a hairstyling process. Also, many such apparatuses are physical difficult to manipulate. Furthermore, many such apparatuses are not easily or quickly adjustable during the hairstyling process and require the mortician to frequently pause in order to adjust the client. In addition, many such apparatuses do not provide an advantageous arrangement accommodating the various tools and other objects used by the mortician during such a process. Accordingly, there exists a need for a mortuary hairstyling trolley without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for mortuary hairstyling trolley which provides simple hands-free adjustment of a client during a hairstyling process as well as quick storage and access for associated tools and objects. Thus, the object of the present invention is to solve the aforementioned disadvantages and provide for this need.

To achieve the above objectives, it is an object of the present invention to provide a table with features enabling a mortician to secure and adjustably position a deceased person in order to style their hair. The apparatus includes a rectangular upper platform to position the deceased person upon and a scissor mechanism which can lift or angle the upper platform to a desired position.

Another object of the present invention is to provide a neck support which supports the deceased person's neck and thereby elevates their head to facilitate hairstyling. The apparatus also includes a plurality of cushions to protect the body while on the apparatus and a plurality of straps to secure the body to the platform.

Yet still another object of the present invention is to provide fluid drainage from the platform into a removable tray via a plurality of vents located within the platform. The tray is housed under the platform and can be slidingly removed for cleaning.

Yet still another object of the present invention is to enable transport or securement of the apparatus using a plurality of lockable wheels located along a bottom surface of a lower platform.

Yet still another object of the present invention is to provide powered lifting and adjustment of the upper platform using the scissor mechanism. The scissor mechanism comprises a plurality of lifting arms in an "X"-shaped orientation which are operated by an electrically powered air compressor.

Yet still another object of the present invention is to securely manipulate the height of the body in a hands-free manner by utilizing a first foot control. The first foot control operates an intermediate actuator via a solenoid bank in order to provide a linear storage against an axle of the scissors mechanism and thereby raise or lower the height of the upper platform.

Yet still another object of the present invention is to securely manipulate the angle of the body in a hands-free manner by utilizing a second foot control. The second foot control operates a pair of distal actuators and devises at a head end of the upper platform, thereby raising or lowering the height of one (1) end of the upper platform and affecting its angle.

Yet still another object of the present invention is to provide storage and access to a desired plurality of tools or objects during hairstyling using a rotatable table which is selectively deployable at a head end of the apparatus and a storage container which can be housed on an upper surface of the lower platform. The apparatus includes a pair of stabilizing feet which provide additional support to the apparatus when it is in an angled state.

Yet still another object of the present invention is to provide a method of utilizing the device that provides a unique means of acquiring the apparatus, transporting the apparatus to a desired location, positioning a deceased body on the upper platform and positioning the neck on the neck support, fastening the straps, depressing the first pedal to lift the apparatus to a desired height, allowing air and fluid to flow through the vents and into the tray, storing items on the lower platform or table as necessary, styling the hair to the deceased person as necessary, and depressing the second foot control to angle the apparatus as necessary.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
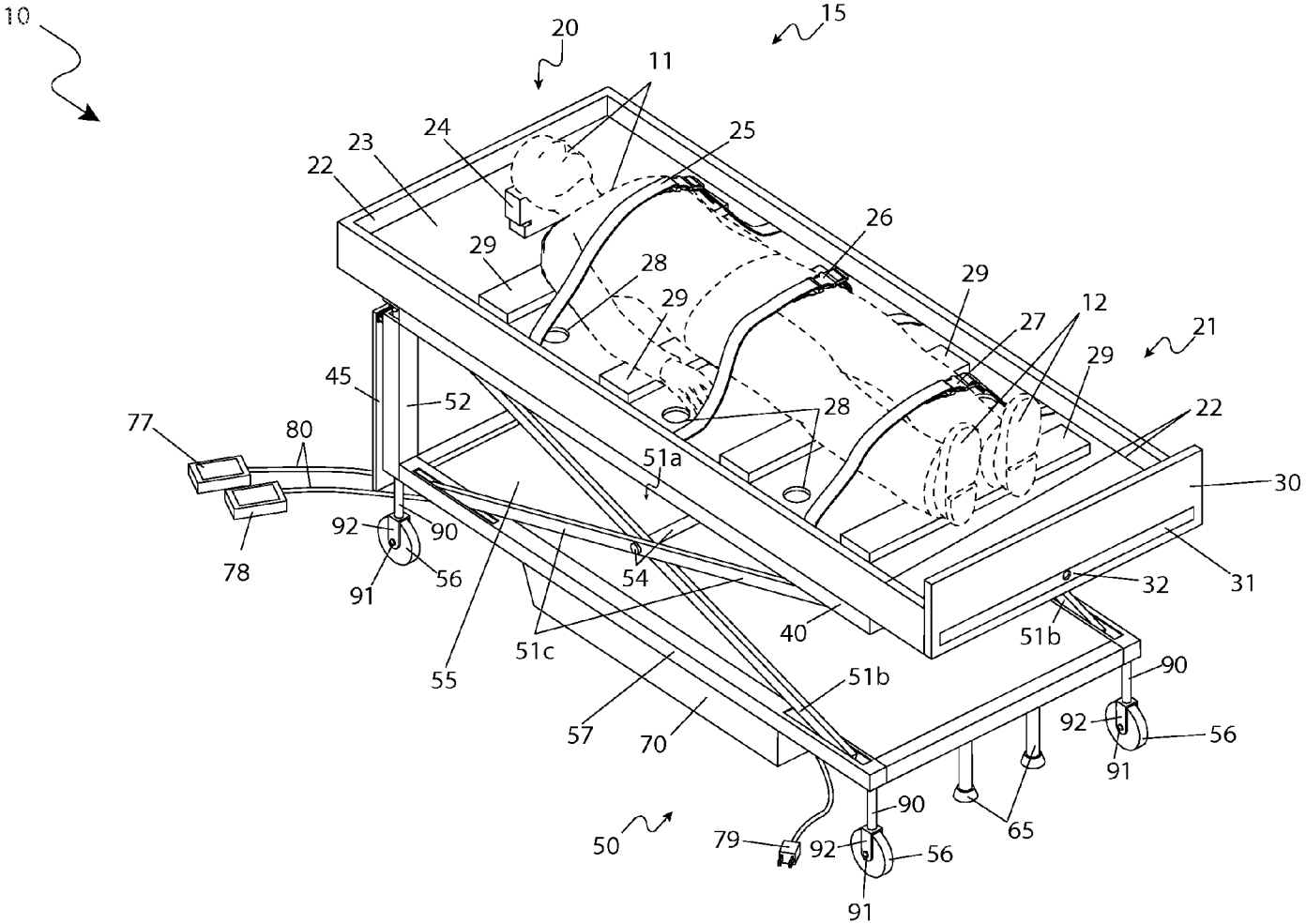
FIG. 1 is an environmental view of a mortuary hairstyling trolley 10, according to a preferred embodiment of the present invention.

| DESCRIPTIVE KEY | |
|---|---|
| 10 | mortuary hairstyling trolley |
| 11 | upper body |
| 12 | lower body |
| 15 | upper platform |
| 20 | distal surface |
| 21 | proximal surface |
| 22 | wall |
| 23 | platform surface |
| 24 | neck support |
| 25 | upper strap |
| 26 | intermediate strap |
| 27 | lower strap |
| 28 | vent |
| 29 | cushion |
| 30 | footrest |
| 31 | tray |
| 32 | drainage aperture |
| 33 | tray aperture |
| 40 | platform support |
| 41 | cross member |
| 45 | table |
| 46 | table hinge |
| 50 | lower frame |
| 51a | scissor mechanism |
| 51b | first lifting arm |
| 51c | second lifting arm |
| 51d | rod end portion |
| 51e | first clearance slot |
| 51g | second clearance slot |
| 51h | roller |
| 51j | pin |
| 51m | aperture |
| 52 | fixed vertical support |

-continued

| DESCRIPTIVE KEY | |
|---|---|
| 53a | first distal actuator |
| 53b | second distal actuator |
| 54 | axle |
| 55 | lower platform |
| 56 | wheel |
| 57 | track |
| 58 | clevis |
| 59 | clevis pin |
| 60 | storage container |
| 61 | lid |
| 62 | base |
| 63 | interior portion |
| 64 | hinge |
| 65 | stabilizing foot |
| 70 | mechanical enclosure |
| 71 | compressor |
| 72 | solenoid |
| 73 | terminal strip |
| 75 | intermediate actuator |
| 76 | connection hose |
| 77 | first foot control |
| 78 | second foot control |
| 79 | power plug |
| 80 | electrical wire |
| 90 | wheel extension |
| 91 | wheel axle |
| 92 | wheel fork |

DETAILED DESCRIPTION OF THE PREFERRED EMBODIMENT

The best mode for carrying out the invention is presented in terms of its preferred embodiment, herein depicted within FIGS. 1 through 12. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a mortuary hairstyling trolley (herein described as the "apparatus") 10, which provides a table with enhanced features to enable a hairstylist to style a secured deceased person's hair with ease. The apparatus 10 comprises a rectangular planar upper platform 15 to position the deceased person upon. The deceased may be lifted or angled to a desired position via a scissor mechanism 51 and internal mechanical and electrical components. The apparatus 10 enables a variety of sized deceased persons to be positioned in a desired and convenient position upon said apparatus 10 which further enables the hairstylist to create a more natural-looking hairstyle.

Referring now to FIG. 1, an environmental view of the apparatus 10, according to the preferred embodiment of the present invention, is disclosed. The apparatus 10 comprises a rectangular upper platform 15 further comprising a distal surface 20 and a proximal surface 21. An upper body 11 (head and neck portion) of the deceased person is positioned on an upper side of the distal surface 20 and a lower body 12 (legs and feet) is positioned on an upper side proximal surface 21.

The back of the deceased person is positioned superjacent to a platform surface 23 perpendicular to a footrest 30 (see below). Once the deceased person is secured onto the apparatus 10 the hairstylist may lift or angle said apparatus 10 to a desired position for common hairstyling procedures. The apparatus 10 also comprises a cuboidal storage container 60 (see FIGS. 11 and 12) which is detached from the main structure enabling a hairstylist to stand or to store common items of the trade inside. The apparatus 10 is approximately eight (8) to ten (10) feet in length and fabricated from a stainless steel, enabling a deceased person weighing up to four hundred (400) pounds to be supported, yet other materials may be utilized without limiting the scope of said apparatus 10.

Figure 2:
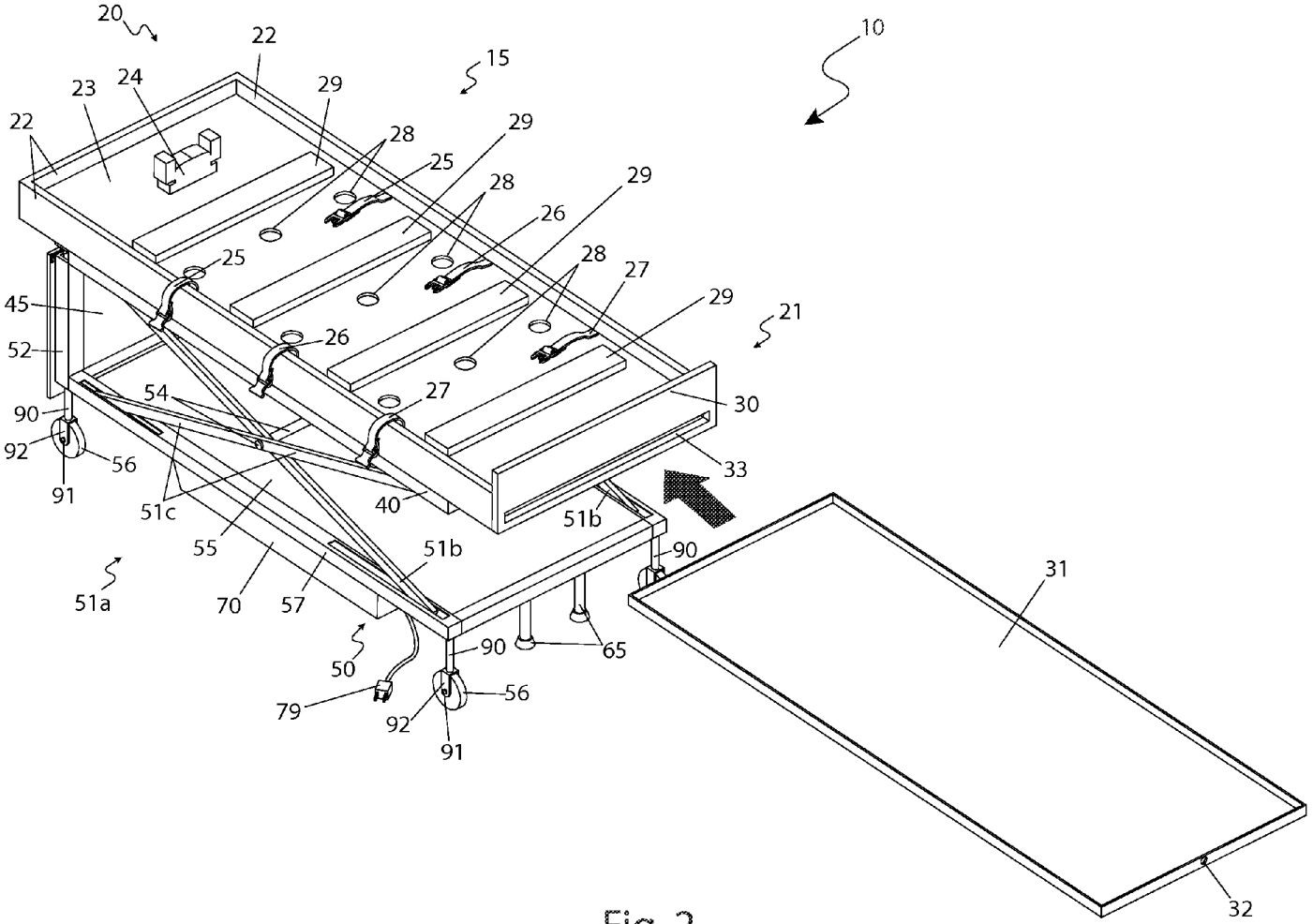
FIG. 2 is a perspective view of the mortuary hairstyling trolley 10 depicting a removed tray 31, according to a preferred embodiment of the present invention.

Referring now to FIG. 2, a perspective view of the apparatus 10 depicting a removed tray 31, according to the preferred embodiment of the present invention, is disclosed. The distal surface 20 and the proximal surface 21 are formed via a plurality of walls 22, a platform 23, and a footrest 30. The platform 23 comprises a neck support means 24 on an upper side of the distal surface 20 providing a support means to the neck of the deceased person and also elevating the head for hairstyling. The neck support 24 comprises an arcuate-shape encompassing the rear and side portions of the neck. The neck support 24 is attached to the platform 23 via means such as, but not limited to: adhesive, integral molding, nuts and bolts, or the like and fabricated from materials such as, but not limited to: foam, plastic, metal, or the like. The platform 23 also comprises an upper strap 25, an intermediate strap 26, and a lower strap 27 providing a means to secure the deceased person to the apparatus 10. The upper strap 25 secures the upper torso region of the deceased person, the intermediate strap 26 secures the waist region of the deceased person, and the lower strap 27 secures the thigh region of the deceased person. Each strap 25, 26, 27 is comprised of a conventional adjustable slide-release buckle fabricated from a durable nylon and attached to the rear platform 23, between the platform 23 and the walls 22 which are upwardly projecting along an outer perimeter edge of platform surface 23.

The platform 23 also comprises a plurality of vents 28 providing a means for the fluids to drain into a removable tray 31. The vents 28 are comprised of a plurality of holes through the platform 23 at appropriate diameters. The tray 31 provides a basin for fluids to collect. Access to the tray 31 is located below the footrest 30 which is perpendicular to an upper side of the proximal end 21 on the rear platform surface 23 and provides placement for the deceased person's feet as desired. The tray 21 is removably placed under the platform 23 via a tray aperture 33 located below the footrest 30. The footrest 30 is integrally molded to the platform surface 23 and the walls 22. The fluids are removed from the tray 31 via interconnecting an existing waste hose to a drainage aperture 32. The hose connected to the drainage aperture 31 is routed to a sink or similar disposal device. The drainage aperture 32 is located on a front surface of the tray 31. Positioned between the vents 28 are a plurality of cushions 29 protecting the deceased body while positioned upon the apparatus 10. The cushions 29 are illustrated herein comprising a rectangular form, yet other forms may be provided without limiting the scope of the apparatus 10. The cushions 29 are comprises of a padded fabric adhered to the platform surface 23, yet other materials may be utilized.

Figure 3:
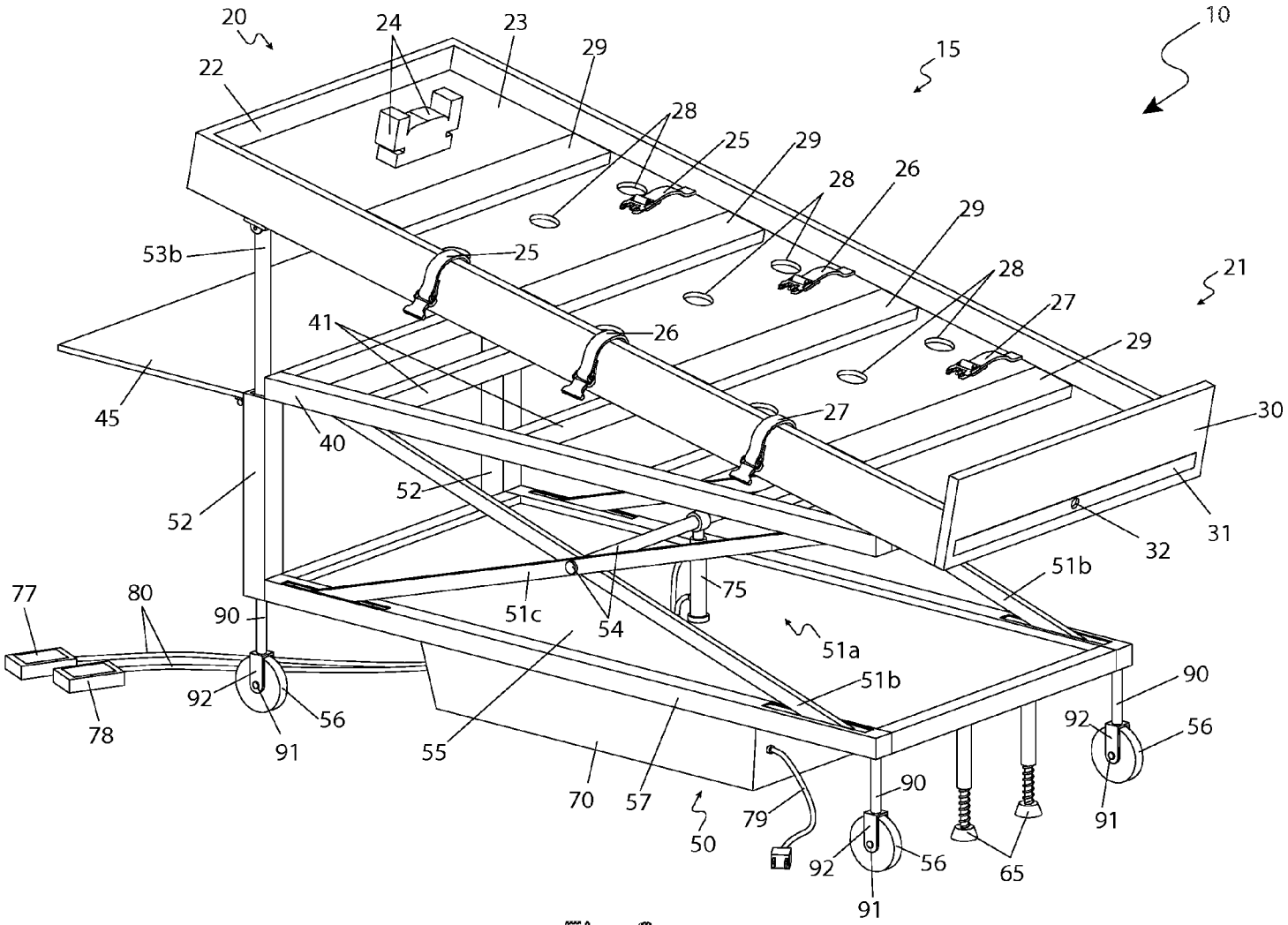
FIG. 3 is another perspective view of the mortuary hairstyling trolley 10 depicting an angled state, according to a preferred embodiment of the present invention.
Figures 4, 5:
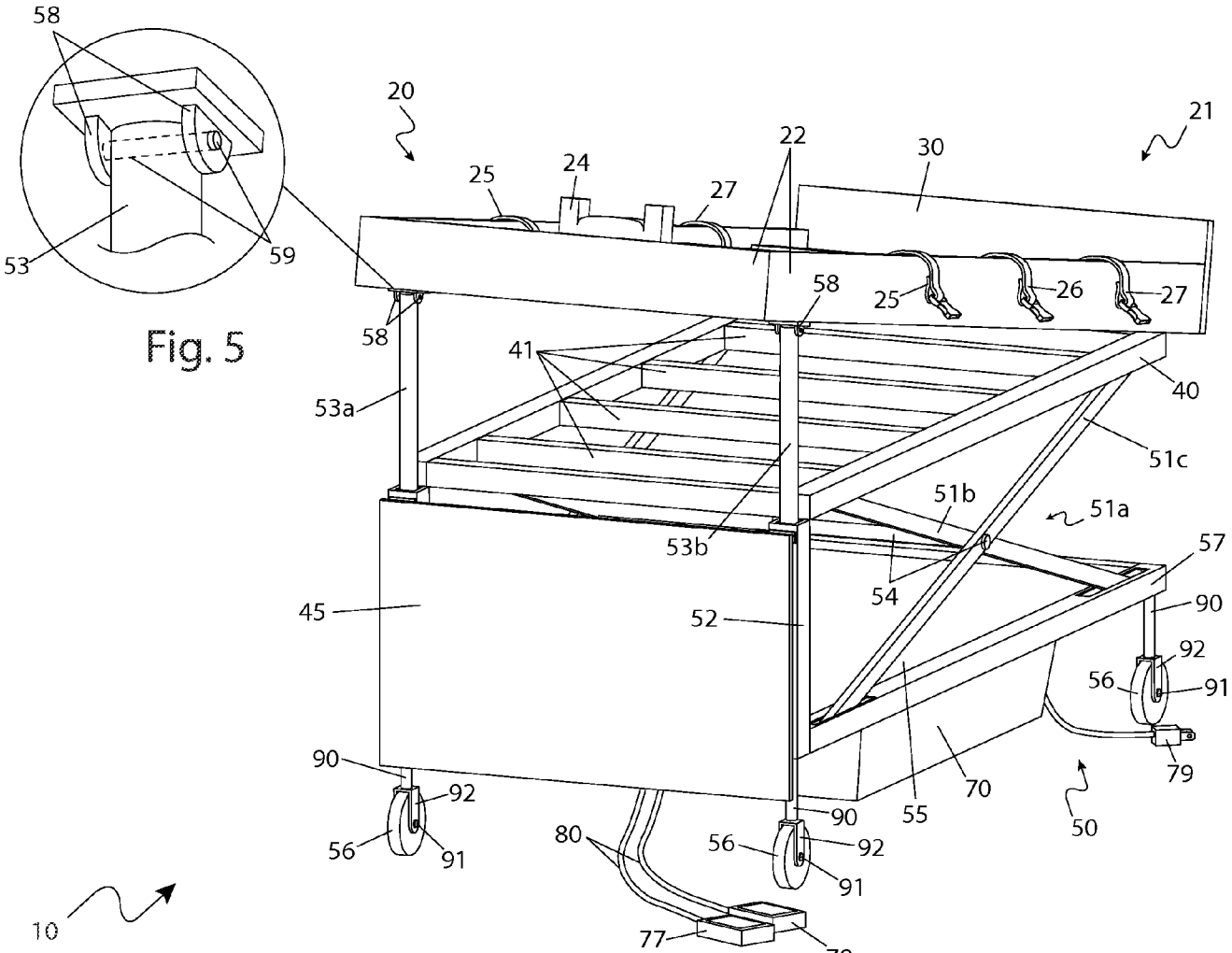
FIG. 4 is a rear perspective view of the mortuary hairstyling trolley 10 depicting an angled state, according to a preferred embodiment of the present invention.
FIG. 5 is a close-up perspective view of a first and a second actuator 53*a*, 53*b*, according to a preferred embodiment of the present invention.

The upper platform 15 is interconnected to a lower frame 50 via a pair of devises 58 which also enable the apparatus 10 to be positioned in an angled state (see FIGS. 3 and 4). Each clevis 58 is attached to an underside distal surface 20 of the upper platform 15 via fastening means such as, but not limited to: welding techniques, hinges, nuts and bolts, or the like. The upper platform 15 is detached from a proximal surface of the platform support 40 which further enables said upper platform 15 to be angled in a desired position.

Figure 6:
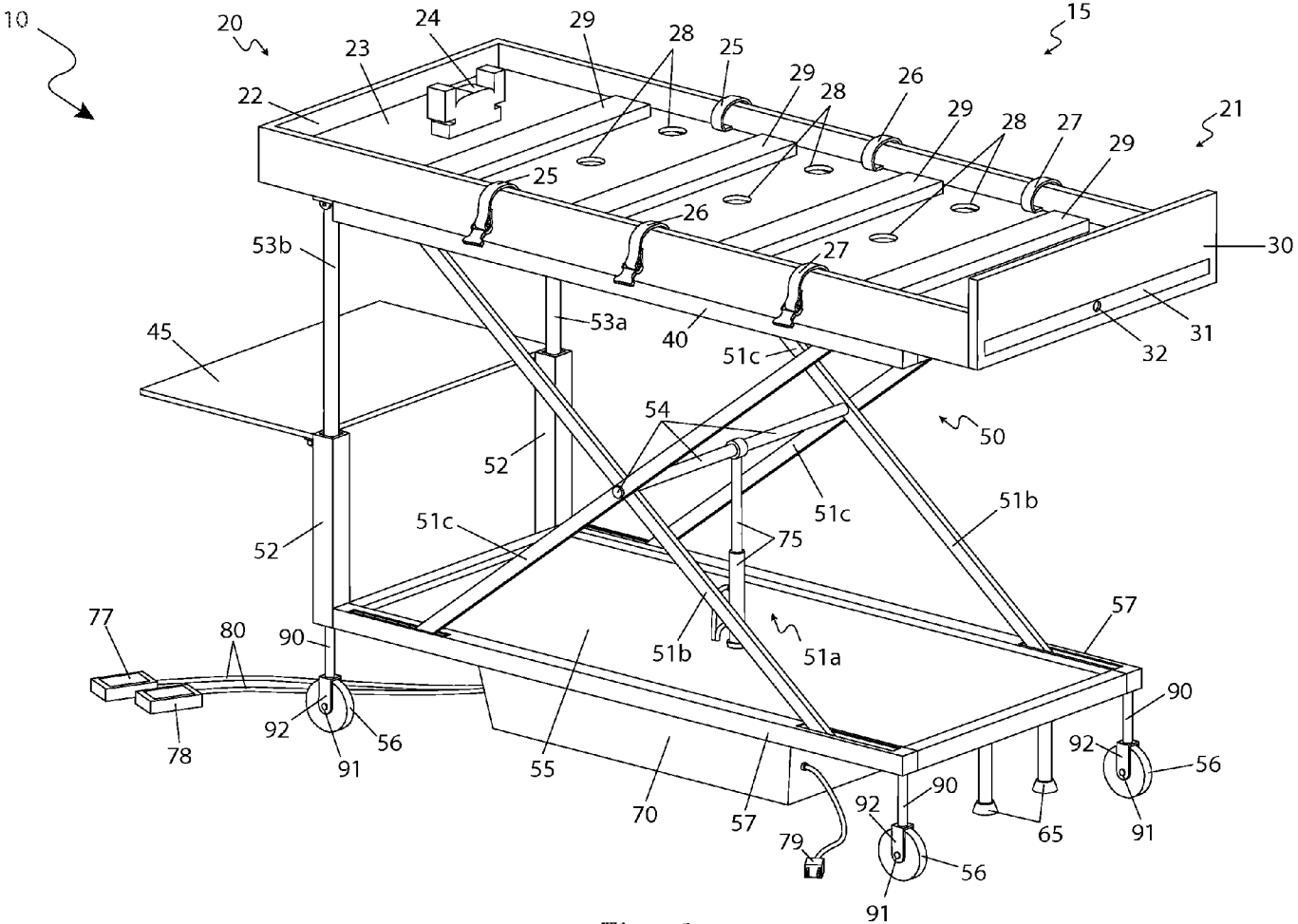
FIG. 6 is yet another perspective view of the mortuary hairstyling trolley 10 depicting an elevated state, according to a preferred embodiment of the present invention.

Referring now to FIG. 3, another perspective view of the apparatus 10 depicting an angled state, FIG. 4, a rear perspective view of the apparatus 10 depicting an angled state, FIG. 5, a close-up perspective view of a hinging means, and FIG. 6, yet another perspective view of the apparatus 10 depicting an elevated, according to the preferred embodiment of the present invention, are disclosed. The lower frame 50 which enables the apparatus 10 to lift and tilt comprises a platform support 40, and is further comprises a frame and plurality of cross-members 41 to support the upper platform 15. The platform support 40 comprises a rectangular shape and is slightly smaller than the upper platform 15. Attached subjacent to the platform support 40 is a scissor mechanism 51*a* which raises and lowers the upper platform 15 to a desired position. The scissor mechanism 51*a* comprises a pair of first lifting arms 51*b* and a pair of second lifting arms 51*c* which are arranged in an "X"-shaped orientation on each opposing side of the apparatus 10 and are interconnected via an intermediate axle 54 which also predetermines the distance between each pair of lifting arms 51*b*, 51*c*. The lifting arms 51*b*, 51*c* travel in a horizontal direction in respective tracks 57 and within an underside portion of the platform support 40. The lifting arms 51*b*, 51*c* are fabricated from stainless steel, yet other materials may be utilized without limiting the functions of the apparatus 10 and are controlled by an intermediate actuator 75 (see herein below). The track 57 is located on the outer perimeter of a lower platform 55 and enables lower rod end portions 51*d* to ride within each opposing lateral portion.

An upper level surface of the lower platform 55 may be utilized as an additional storage means to the apparatus 10. The lower platform 55 also creates an area for additional parts of the apparatus 10 to be attached such as a pair of stabilizing feet 65 and a mechanical enclosure 70 (see FIG. 7). The pair of stabilizing feet 65 provides a stabilizing means to the apparatus 10 when it is positioned in an angled state. The stabilizing feet 65 are manually height adjustable via a common threading means and are located at an underside of the lower platform 55. The stabilizing feet 65 are attached to the underside of the lower platform 55 via integral molding or similar attachment methods.

A pair of fixed vertical members 52 perpendicular to the lower platform 55 houses distal actuators 53*a*, 53*b* which enable the apparatus 10 to be angled to a desired position. The fixed vertical members 52 comprise a hollow rectangular shape which are attached to a distal end of the lower platform 55 via conventional welding techniques or the like and allow for internal routing of connection hoses 76 and electrical wiring 80 to each distal actuator 53*a*, 53*b*.

The intermediate actuator 75 is attached to an intermediate portion of the axle 54 with common mechanical fasteners and provides a linear force against said axle 54 to further provide a linear stroke which raises or lowers the lifting arms 51*b*, 51*c* simultaneously. The intermediate actuator 75 is partially contained in the mechanical enclosure 70 located below the lower platform 55. The mechanical enclosure 70 houses a compressor 71, a solenoid bank 72, a terminal strip 73, and other necessary items. The hairstylist is able to control the height of the apparatus 10 via a first foot control 77 and the angle of said apparatus 10 via a second foot control 78 which are routed from the mechanical enclosure 70 to a desired location via appropriately gauged electrical wire 80 (also see FIG. 10). The first foot control 77 preferably controls the intermediate actuator 75 to raise or lower the scissor mechanisms 51. The second foot control 78 preferably controls a first distal actuator 53*a* and a second distal actuator 53*b*. The foot controls 77, 78 are comprised of conventional hands-free foot-switches, yet other switching devices may be utilized without limiting the functions of the apparatus 10.

As abovementioned, the second foot control 78 manipulates the distal actuators 53*a*, 53*b* which are preferably comprised of conventional air actuated cylinders, yet other mechanical devices may be utilized without limiting the functions of the apparatus 10. The distal actuators 53*a*, 53*b* raise and lower respectively to the position of the second foot control 78 which enables the upper platform 15 to be angled to a desired position. An upper portion of each distal actuator 53*a*, 53*b* is attached to the abovementioned clevis 58 by a clevis pin 59. As the distal actuators 53*a*, 53*b* are raised a linear force is exerted on the clevis 58 and concurrently the upper platform 15 which enables the distal surface 20 of said upper platform 15 to raise upwardly to a desired degree.

The wheels 56 are located subjacent to the lower platform 55 at each corner and preferably comprise a conventional locking means which prohibit said wheels 56 from rotating as desired. Each wheel 56 is attached to the underside of the lower platform 55 via a wheel extension 90 which is further attached to said underside via common welding techniques. The wheel extensions 90 are integrally molded to a wheel fork 92 which positions and secures the wheel 56 via an axle 91.

A rotatable table 45 is attached to a rear portion of each fixed vertical member 52 via a table hinge 46. The table hinge 46 preferably comprises a locking feature which would enable the table 45 to be positioned and secured in an upright manner. The table 45 enables a hairstylist to utilize said table 45 for positioning necessary items to subsequent use. The table 45 is fabricated from materials such as, but not limited to: stainless steel, plastic, wood, or the like.

Figure 7:
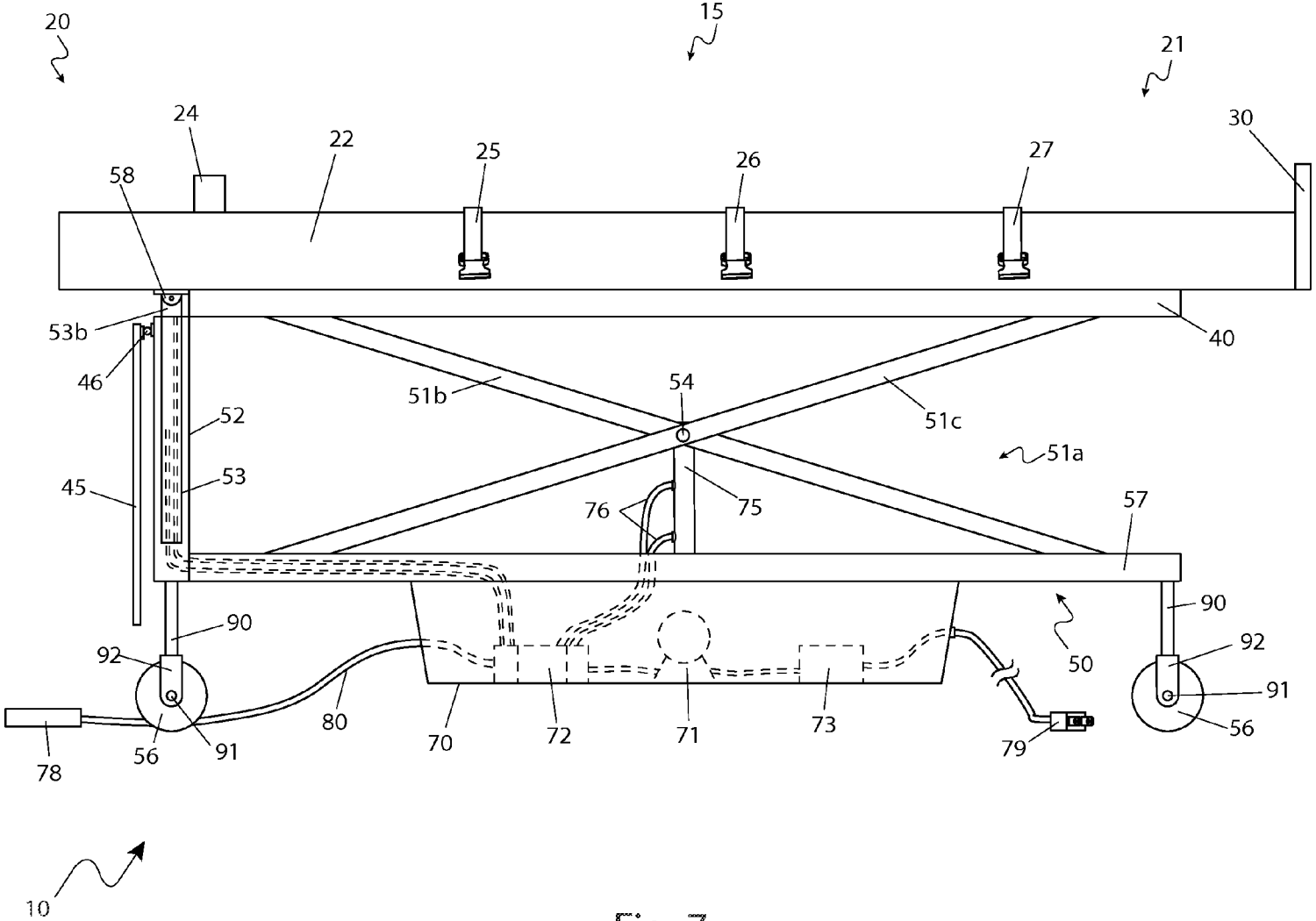
FIG. 7 is a side view of the mortuary hairstyling trolley 10, according to a preferred embodiment of the present invention.
Figure 8:
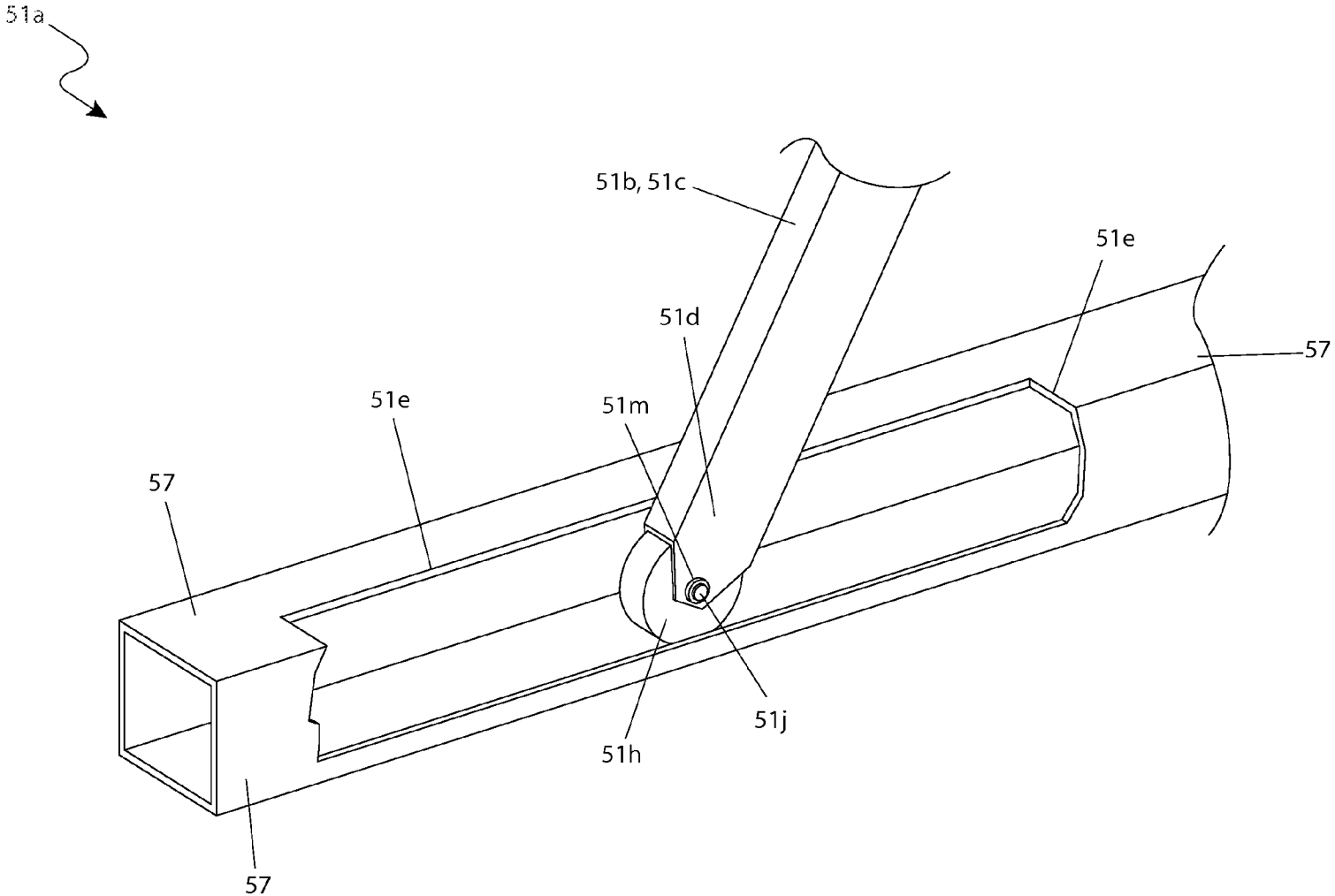
FIG. 8 is a cut-away view of a rod end portion 51*d*, according to a preferred embodiment of the present invention.
Figure 9:
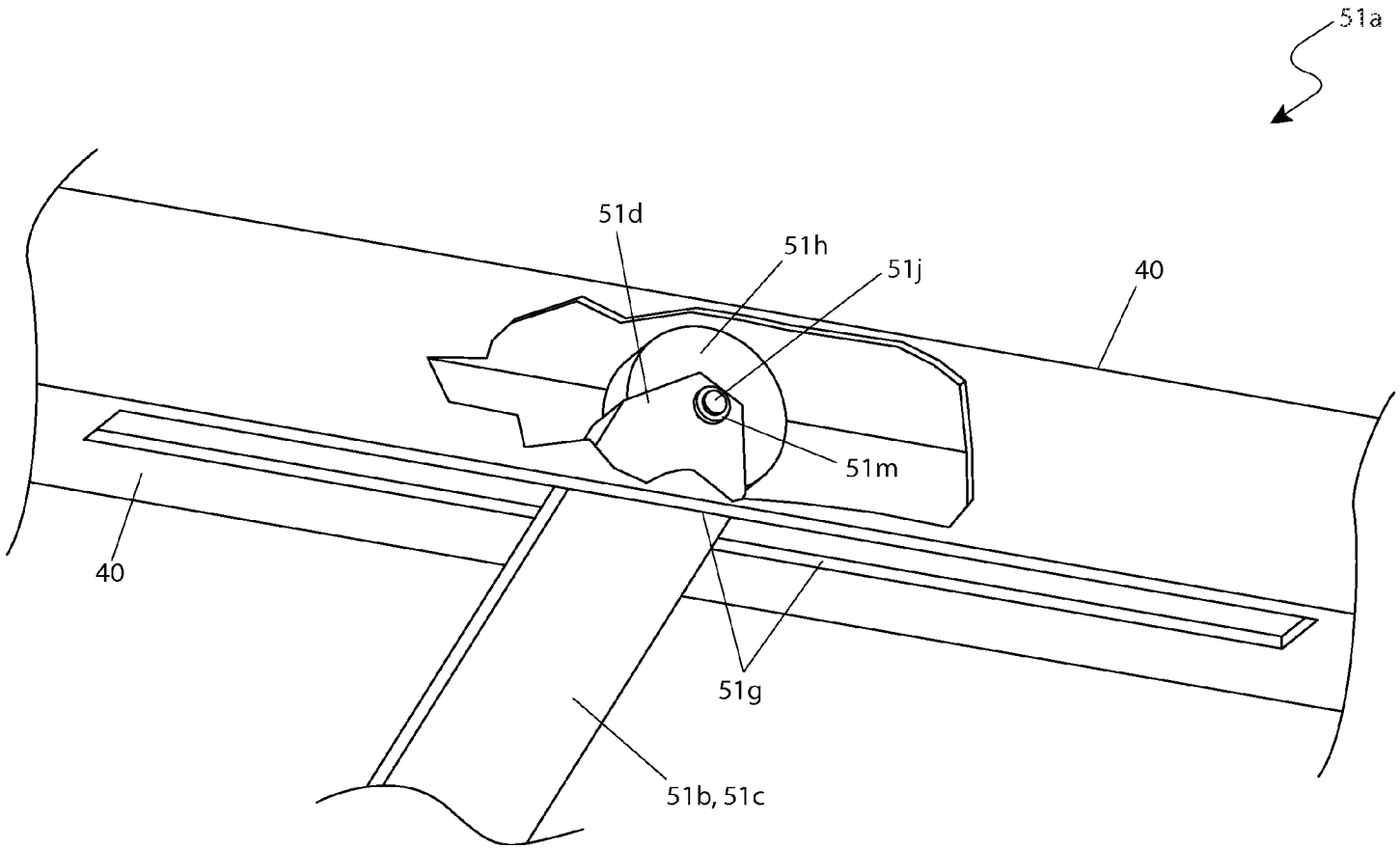
FIG. 9 is an opposing cut-away view of the rod end portion 51*d*, according to a preferred embodiment of the present invention.

Referring now to FIG. 7, a side view of the apparatus 10, FIG. 8, a cut-away view of a rod end portion 51*d*, and FIG. 9, an opposing cut-away view of the rod end portion 51*d*, according to the preferred embodiment of the present invention, are disclosed. The scissor mechanism 51*a* provides a pair of scissors-type lifting devices at opposing intermediate positions of the apparatus 10. Each scissors-like device comprises a first lifting arm 51*b* and a second lifting arm 51*c* being arranged in a diagonal crossing pattern and joined at respective intermediate points using an axle 54. The operable motioning of the previously described intermediate actuator 75 results in synchronous motioning with the lifting arms 51*b*, 51*c*. Each first lifting arm 51*b* and each second lifting arm 51*c* further comprises a pair of opposing rod end portion 51*d* at each end portion. Each lifting arm 51*b*, 51*c* protrudes downwardly through a first clearance slot feature 51*e* comprising a rectangular opening cut into a top surface of the track 57 allowing respective rod end portions 51*d* of each arm 51*b*, 51*c* to motion laterally in a guided manner within each said track 57. In like manner each lifting arm 51*b*, 51*c* protrudes upwardly through a second clearance slot 51*g* comprising a rectangular opening cut into a bottom surface of a respective platform support 40 allowing said rod end portions 51*d* of each arm 51*b*, 51*c* to motion laterally in a guided manner within said platform support 40.

The rod end portions 51*d* located at bottom end portions each lifting arm 51*b*, 51*c* further comprise axially-mounted cylindrical rollers 51*h* via pins 51*j* inserted into a respective aperture 51*m* to allow smooth motioning of said rod end portions 51*d* within the track 57 and platform support 40.

Figure 10:
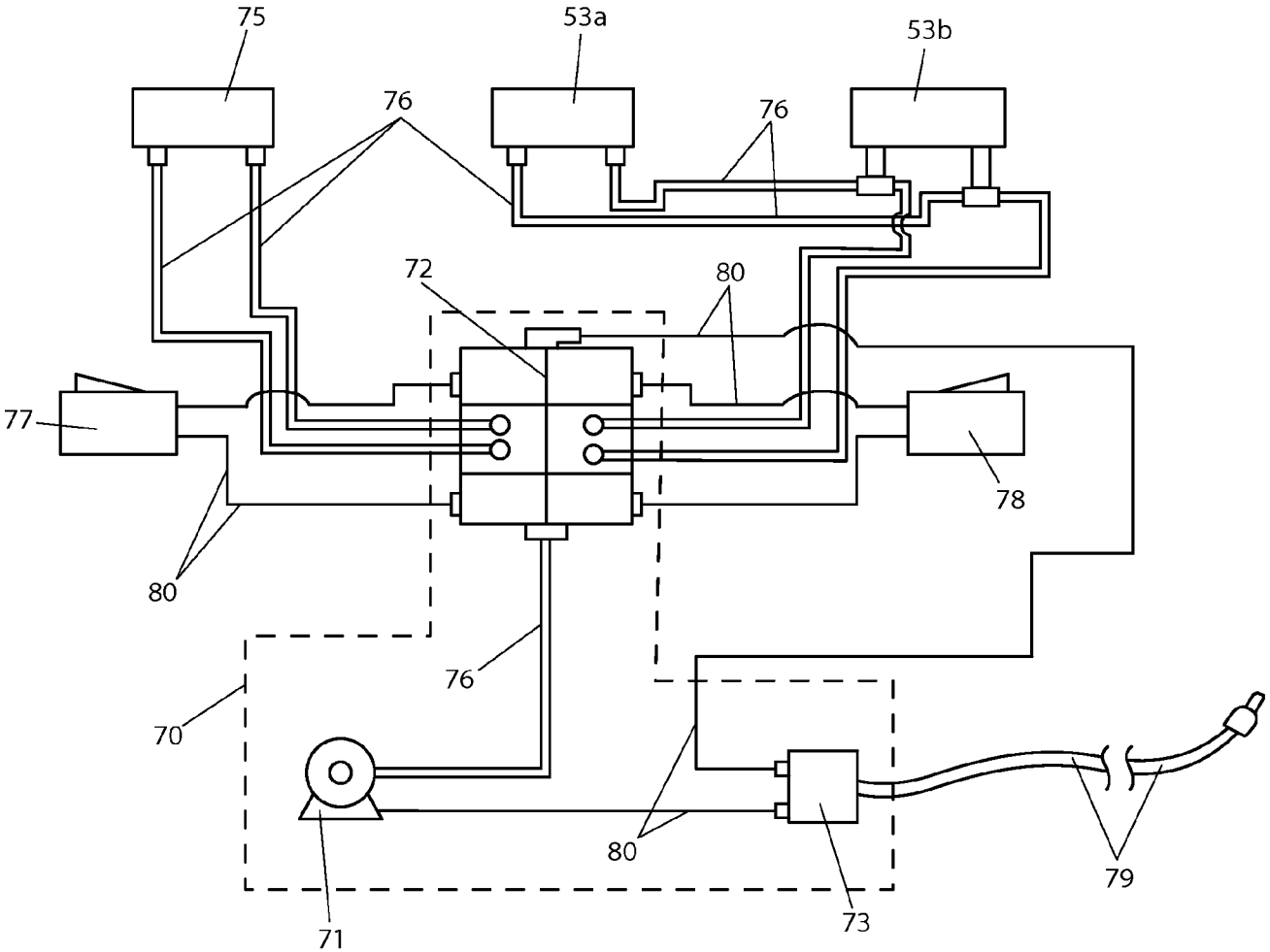
FIG. 10 is a mechanical flow diagram of the major components of the mortuary hairstyling trolley 10 depicting an angled state, according to a preferred embodiment of the present invention.

Referring now to FIG. 10, a mechanical flow diagram of the major components of the apparatus 10 depicting an angled state, according to the preferred embodiment of the present invention, is disclosed. The apparatus 10 receives power from an existing 110-volt house hold receptacle via a power plug 79. The power plug 79 is interconnected to a terminal strip 73 which routes the power to a common air compressor 71 and solenoid 72. The compressor 71 creates an air flow through connection hose 76 to the solenoid 72. The solenoid 72 is interconnected to the foot controls 77, 78 via appropriately gauged electrical wire 80. The solenoid 72 is also interconnected to the actuators 53*a*, 53*b*, 75 via connection hose 76. The solenoid 72 is preferably a three (3) position double solenoid valve, yet other devices may be utilized without limiting the scope of apparatus 10. The intermediate actuator 75 is preferably an air-actuated cylinder which is similar to the distal actuators 53*a*, 53*b*. The intermediate actuator 75 is manipulated by the first foot control 77 and the distal actuators 53*a*, 53*b* are manipulated by the second foot control 78. The solenoid 72 dispenses air flow to a respective actuator 53*a*, 53*b*, 75 as determined by the signal sent from the respective foot control 77, 78.

Figure 11:
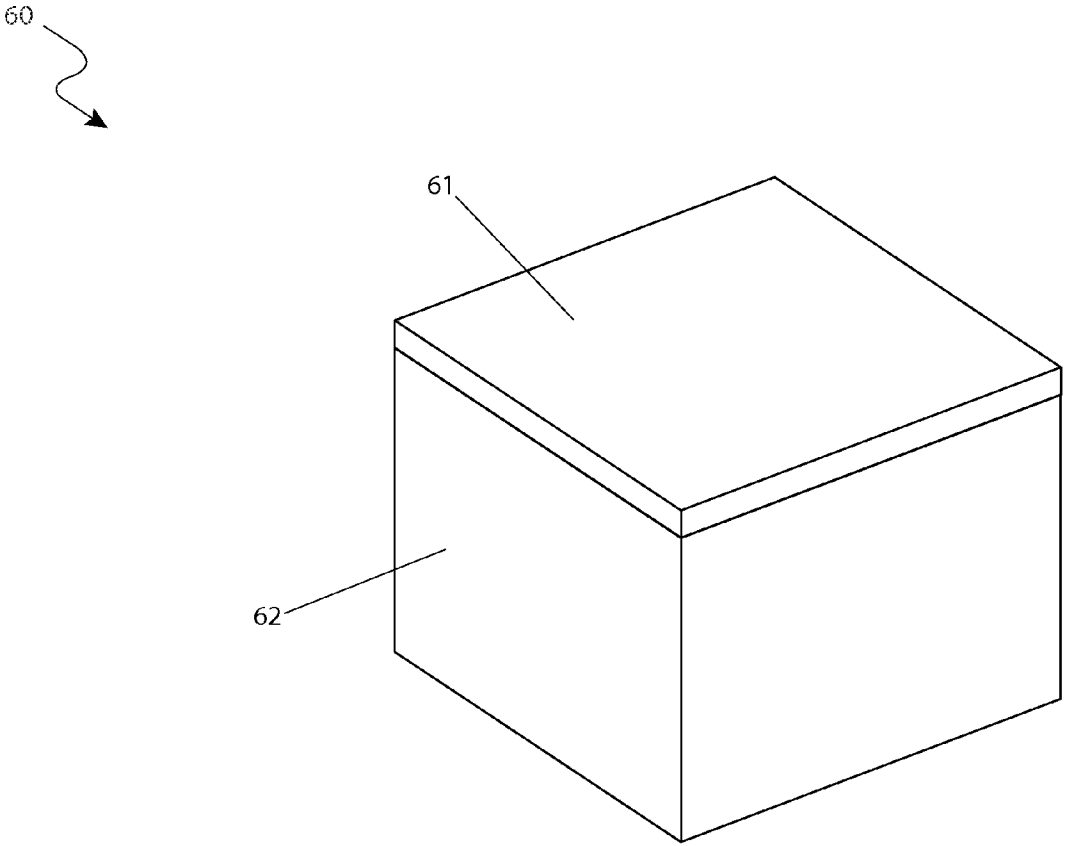
FIG. 11 is a perspective view of a storage container 60, according to a preferred embodiment of the present invention; and, FIG. 12 is a rear perspective view of the storage container 60 depicting an open state, according to a preferred embodiment of the present invention.
Figure 12:
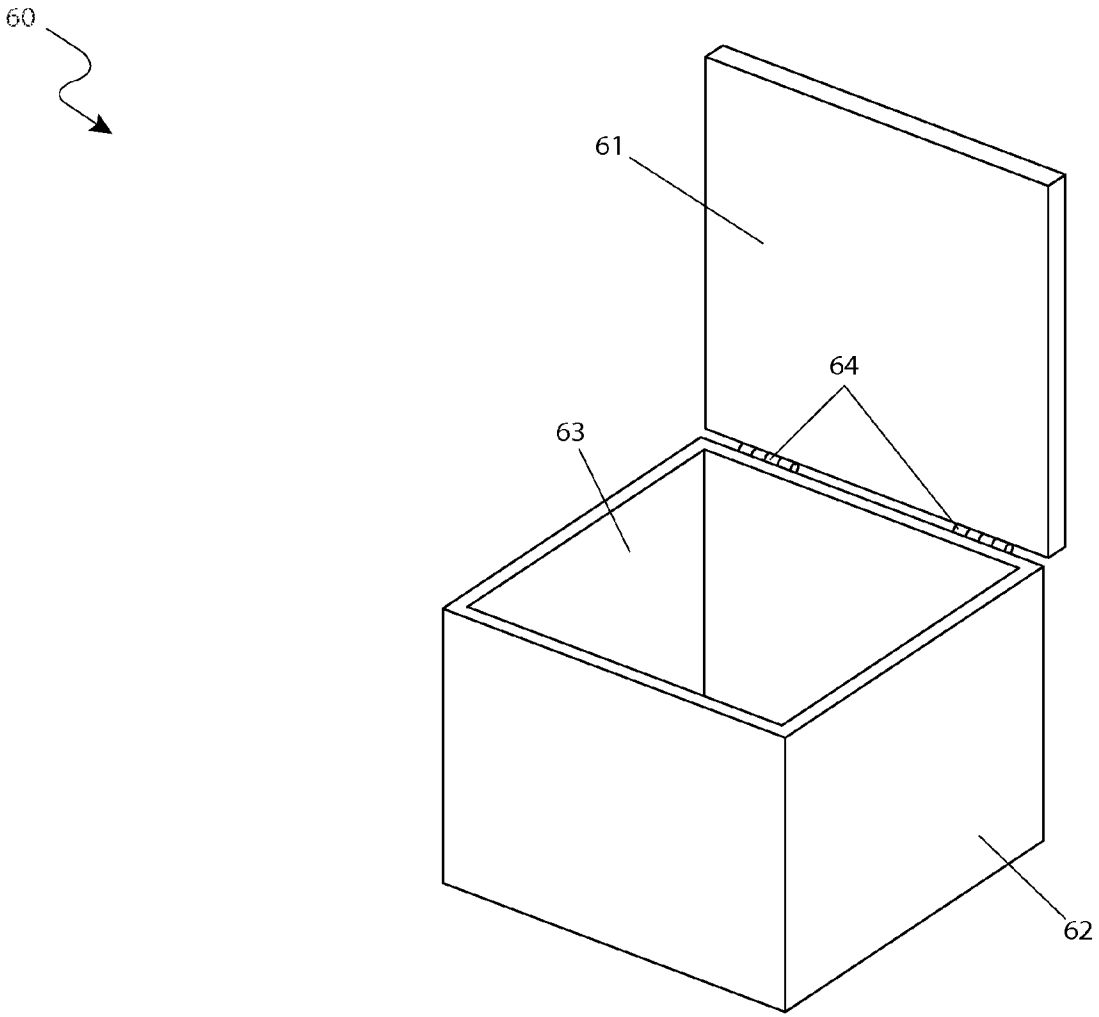

Referring now to FIG. 11, a perspective view of the storage container 60 and FIG. 12, a rear perspective view of the storage container 60 depicting an open state, according to the preferred embodiment of the present invention, are disclosed. The apparatus 10 comprises an isolated cuboidal storage container 60 providing a platform for the hairstylist to stand on and providing a storage means to desired equipment. The storage container 60 comprises a base 62 providing an interior portion 63 for storing items. The base 62 is fabricated from materials such as, but not limited to: stainless steel, wood, plastic, or the like. A pair of conventional hinges 64 is attached to an upper perimeter edge of the base 62 interconnecting a lid 61 to the base 62. The lid 61 provides a closing feature to the base 62 and also providing a stable structure for the hairstylist to stand on. The lid 61 is fabricated from similar materials as the base 62. An outer portion of the lid 61 comprises a rubberized or padded surface which prohibits slipping or falling while a person stands on top of the storage container 60.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of utilizing the apparatus 10 may be achieved by performing the following steps: acquiring the apparatus 10; transporting said apparatus 10 via the wheels 56 to a desired location; depressing the first pedal 77 to lower the intermediate actuator 75 and to position said apparatus 10 in a lowered horizontal state; positioning a deceased body on the upper platform 15 upon the cushions 29; enabling the feet of the deceased person to rest upon the footrest 30 as desired; positioning the neck of the deceased person on the neck support 24; fastening the straps 25, 26, 27 around the deceased person which secures the body to the upper platform 15; depressing the first pedal 77 to extend the intermediate actuator 75 and lift the apparatus 10 to a desired height; allowing air and fluid to flow through the vents 28 and into the tray; allowing fluid to drain from the drainage aperture 32 upon the tray 31; storing items on the lower platform 55 or table 45 as necessary; styling the hair to the deceased person as necessary; positioning the apparatus 10 to a lowered horizontal position when finished; removing the tray 31 as desired; unfastening the straps 25, 26, 27; removing the deceased person from the upper platform 15; utilizing the apparatus 10 as necessary; and, utilizing the apparatus 10 to style a deceased persons hair in a manner which is quick, effective, and easy.

The method of angling the apparatus 10 may be achieved by performing the following steps: depressing the second foot control 78 send a signal to the solenoid 72 to concurrently enable air flow from the compressor 71 to be routed to the distal actuators 53*a*, 53*b*; angling the apparatus 10 to a desired position; adjusting the stabilizing feet 65 as desired; depressing the second foot control 78 again to lower the distal actuators 53*a*, 53*b* as desired; and, angling the apparatus as necessary.

The method of utilizing the storage container 60 may be achieved by performing the following step: placing the storage container 60 on a level desired surface; motioning the lid 61 via the hinges 64 to an open state; filling the interior portion 63 as desired; closing the lid 61; and, utilizing the storage container 60 as desired.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A mortuary hairstyling trolley, comprising:

a planar upper platform, comprising a generally rectangular upper surface with a perimeter lip, a distal end, and a proximal end;

a plurality of restraining means located along a length of said platform;

a lower frame for supporting a lower side of said upper platform, further comprising:

a platform support affixed to said lower side of said upper platform, comprising a perimeter frame member;

a planar lower platform, comprising a generally rectangular lower surface with a perimeter frame member, a distal end, and a proximal end;

a transporting means attached to a lower side of said lower platform;

a tilting means affixed to said distal end of said lower platform and operably attached to a lower side of said distal end of said upper platform for tilting said distal end relative to said lower platform; and, a lifting means affixed to a central location of said lower platform operably attached to said platform support for lifting said upper platform relative to said lower platform; and, a control means for controlling and in electrical communication with said lifting means and said tilting means;

wherein a deceased individual is placed on said upper platform, such that a head and neck region of said deceased individual is located on said distal end of said upper platform and said leg and foot region is located on said proximal end of said upper platform;

wherein said deceased individual is secured to said upper platform via said plurality of restraining means;

wherein said upper platform is tilted to a desired angle by said tilting means; and, wherein upper platform is raised to a desired height by said lifting means;

a neck support means affixed on said upper surface of said distal side, comprising a cushioning arcuate pad;

a plurality of vents located along said upper platform; a plurality of cushions affixed on said upper surface along said length of said upper platform each located closer to a longitudinal centerline of said upper platform from said plurality of vents;

a footrest comprising an extended portion of said lip and located along an entire edge of said proximal end;

a tray opening located subjacent to said footrest; and, a generally rectangular tray removably inserted within said tray opening, comprising a planar surface and a rear plate upstanding from a rear edge thereof, further having a drain aperture;

wherein said neck support supports said neck and head region of said deceased individual;

wherein said plurality of cushions supports and cushions said deceased individual; wherein said tray is in fluid communication with said plurality of vents when inserted within said tray opening such that any collected fluids travel through said plurality of vents and collect within said tray;

wherein said drain aperture is adapted to removably receive a drain hose; and, wherein said drain aperture communicates said collected fluids away from said tray.

2. The trolley of claim 1, wherein said plurality of restraining means each further comprises a pair of straps with a buckle removably conjoining said pair of straps together, each pair of straps affixed between said upper surface of said upper platform and said lip.

3. The trolley of claim 2, wherein said plurality of restraining means further comprises:

an upper strap, located adjacent to said neck strap for securing an upper region of said deceased individual;

an intermediate strap located at an intermediate location for securing a waist region of said deceased individual; and, a lower strap located adjacent to said footrest for securing a lower region of said deceased individual.

4. The trolley of claim 3, wherein said platform support further comprises a pair of side rails affixed to a bottom surface of said upper platform in a parallel arrangement, each having a first end affixed to an upper end of said tilting means and a plurality of cross-members spanning a width between said pair of side rails.

5. The trolley of claim 4, wherein said transporting means further comprises a wheel assembly located at each corner of a bottom side of said lower platform;

wherein each wheel assembly further comprises a wheel extension, a wheel fork, and a wheel rotatable affixed to said wheel fork; and, wherein each wheel assembly further comprises a locking means for locking rotation of a wheel.

6. The trolley of claim 4, further comprising a pair of stabilizing legs attached to said bottom side of said proximal end of said lower platform equidistantly-spaced from a longitudinal centerline, each further having a height adjustable foot.

7. The trolley of claim 5, wherein said tilting means further comprises:

a pair of devises affixed to opposing corners of said lower side of said distal end of said upper platform;

a pair of distal actuators each having a fixed portion affixed to opposing corners of an upper surface of said distal end of said lower platform and a movable portion slidably engaged within said fixed portion affixed to an individual clevis with a clevis pin; and, a table hingedly affixed to distal sides of each of said fixed portion of said pair of distal actuators;

wherein said movable portion is operably simultaneously controlled by said control means; and, wherein said movable portion raises and lowers said distal end of said upper platform to a desired angle.

8. The trolley of claim 7, wherein said lifting means further comprises:

a pair of scissor mechanisms, each having a bottom portion movably retained in a track of each longitudinal frame member of said lower platform and an upper portion movably retained in a track of each side rail of said platform support, each pair further comprising a first lifting arm and a second lifting arm having rolling members at terminal ends thereof;

an axle attached to inner portions of each of said pair of scissor mechanisms and spanning a distance between; and, an intermediate actuator mechanically connected to said control means and located on a central location of said upper side of said lower platform;

wherein said axle is operably controlled by said intermediate actuator;

wherein said intermediate actuator is operably controlled by said control means;

wherein said pair of scissor mechanisms raises and lowers said platform support and said upper platform to a desired height; and, wherein said pair of scissor mechanisms travel horizontally within said tracks of said lower platform and said platform support.

9. The trolley of claim 8, wherein said control means further comprises:

an enclosure mounted to a central location on said bottom side of said lower platform;

a terminal strip having a power cord routed outside of said enclosure for removable electrical communication with a power supply;

a compressor in electrical communication with said terminal strip;

a solenoid bank in electrical communication with said terminal strip, further comprising an inlet connection hose in fluid communication with said compressor, a first outlet connection hose in fluid communication with said intermediate actuator and a pair of second outlet connection hoses each in fluid communication with each of said pair of distal actuators;

a first foot control in electrical communication with said solenoid bank, operably controlling said first outlet connection hose connected and located external of said enclosure a second foot control in electrical communication with said solenoid bank, operably controlling said second outlet connection hose and located external of said enclosure;

wherein said terminal strip supplies power to said compressor and said terminal strip;

wherein said compressor delivers compressed air to said solenoid bank;

wherein when said first foot control is activated, said compressed air is delivered to operably control said lifting means; and, wherein when said second foot control is activated, said compressed air is delivered to operably control said tilting means.

10. A mortuary hairstyling trolley, comprising:

a planar upper platform, comprising a generally rectangular upper surface with a perimeter lip, a distal end, and a proximal end;

a plurality of restraining means located along a length of said platform;

a lower frame for supporting a lower side of said upper platform, further comprising:

a platform support affixed to said lower side of said upper platform, comprising a perimeter frame member;

a planar lower platform, comprising a generally rectangular lower surface with a perimeter frame member, a distal end, and a proximal end;

a transporting means attached to a lower side of said lower platform;

a tilting means affixed to said distal end of said lower platform and operably attached to a lower side of said distal end of said upper platform for tilting said distal end relative to said lower platform; and, a lifting means affixed to a central location of said lower platform operably attached to said platform support for lifting said upper platform relative to said lower platform;

a control means for controlling and in electrical communication with said lifting means and said tilting means; and, a storage container, comprising a box-like structure having a hinged lid affixed to a top portion thereof, said lid having a non-slip upper surface;

wherein a deceased individual is placed on said upper platform, such that a head and neck region of said deceased individual is located on said distal end of said upper platform and said leg and foot region is located on said proximal end of said upper platform;

wherein said deceased individual is secured to said upper platform via said plurality of restraining means;

wherein said upper platform is tilted to a desired angle by said tilting means;

wherein upper platform is raised to a desired height by said lifting means;

wherein said storage container provides a means to store hairstyling accessories; and, wherein said storage container provides a means for a user to stand on to access said deceased individual;

a neck support means affixed on said upper surface of said distal side, comprising a cushioning arcuate pad;

a plurality of vents located along said upper platform;

a plurality of cushions affixed on said upper surface along a length said upper platform each located closer to a longitudinal centerline of said upper platform from said plurality of vents;

a footrest comprising an extended portion of said lip and located along an entire edge of said proximal end;

a tray opening located subjacent to said footrest; and, a generally rectangular tray removably inserted within said tray opening, comprising a planar surface and a rear plate upstanding from a rear edge thereof, further having a drain aperture;

wherein said neck support supports said neck and head region of said deceased individual;

wherein said plurality of cushions supports and cushions said deceased individual;

wherein said tray is in fluid communication with said plurality of vents when inserted within said tray opening such that any collected fluids travel through said plurality of vents and collect within said tray;

wherein said drain aperture is adapted to removably receive a drain hose; and, wherein said drain aperture communicates said collected fluids away from said tray.

11. The trolley of claim 10, wherein said plurality of restraining means each further comprises a pair of straps with a buckle removably conjoining said pair of straps together, each pair of straps affixed between said upper surface of said upper platform and said lip.

12. The trolley of claim 11, wherein said plurality of restraining means further comprises:

an upper strap, located adjacent to said neck strap for securing an upper region of said deceased individual;

an intermediate strap located at an intermediate location for securing a waist region of said deceased individual; and, a lower strap located adjacent to said footrest for securing a lower region of said deceased individual.

13. The trolley of claim 12, wherein said platform support further comprises a pair of side rails affixed to a bottom surface of said upper platform in a parallel arrangement, each having a first end affixed to an upper end of said tilting means and a plurality of cross-members spanning a width between said pair of side rails.

14. The trolley of claim 13, wherein said transporting means further comprises a wheel assembly located at each corner of a bottom side of said lower platform;

wherein each wheel assembly further comprises a wheel extension, a wheel fork, and a wheel rotatable affixed to said wheel fork; and, wherein each wheel assembly further comprises a locking means for locking rotation of a wheel.

15. The trolley of claim 13, further comprising a pair of stabilizing legs attached to said bottom side of said proximal end of said lower platform equidistantly-spaced from a longitudinal centerline, each further having a height adjustable foot.

16. The trolley of claim 14, wherein said tilting means further comprises:

a pair of devises affixed to opposing corners of said lower side of said distal end of said upper platform;

a pair of distal actuators each having a fixed portion affixed to opposing corners of an upper surface of said distal end of said lower platform and a movable portion slidably engaged within said fixed portion affixed to an individual clevis with a clevis pin; and, a table hingedly affixed to distal sides of each of said fixed portion of said pair of distal actuators;

wherein said movable portion is operably simultaneously controlled by said control means; and, wherein said movable portion raises and lowers said distal end of said upper platform to a desired angle.

17. The trolley of claim 16, wherein said lifting means further comprises:

a pair of scissor mechanisms, each having a bottom portion movably retained in a track of each longitudinal frame member of said lower platform and an upper portion movably retained in a track of each side rail of said platform support, each pair further comprising a first lifting arm and a second lifting arm having rolling members at terminal ends thereof;

an axle attached to inner portions of each of said pair of scissor mechanisms and spanning a distance between; and, an intermediate actuator mechanically connected to said control means and located on a central location of said upper side of said lower platform;

wherein said axle is operably controlled by said intermediate actuator;

wherein said intermediate actuator is operably controlled by said control means;

wherein said pair of scissor mechanisms raises and lowers said platform support and said upper platform to a desired height; and, wherein said pair of scissor mechanisms travel horizontally within said tracks of said lower platform and said platform support.

18. The trolley of claim 17, wherein said control means further comprises:

an enclosure mounted to a central location on said bottom side of said lower platform;

a terminal strip having a power cord routed outside of said enclosure for removable electrical communication with a power supply;

a compressor in electrical communication with said terminal strip;

a solenoid bank in electrical communication with said terminal strip, further comprising an inlet connection hose in fluid communication with said compressor, a first outlet connection hose in fluid communication with said intermediate actuator and a pair of second outlet connection hoses each in fluid communication with each of said pair of distal actuators;

a first foot control in electrical communication with said solenoid bank, operably controlling said first outlet connection hose connected and located external of said enclosure a second foot control in electrical communication with said solenoid bank, operably controlling said second outlet connection hose and located external of said enclosure;

wherein said terminal strip supplies power to said compressor and said terminal strip;

wherein said compressor delivers compressed air to said solenoid bank;

wherein when said first foot control is activated, said compressed air is delivered to operably control said lifting means; and, wherein when said second foot control is activated, said compressed air is delivered to operably control said tilting means.

* * * * *